United States Patent [19]

Parker

[11] 4,349,610

[45] Sep. 14, 1982

[54] METHOD FOR WATERPROOFING PAPER

[75] Inventor: Daniel Parker, Los Angeles, Calif.

[73] Assignee: Beloit Corporation, Beloit, Wis.

[21] Appl. No.: 197,228

[22] Filed: Oct. 15, 1980

Related U.S. Application Data

[63] Continuation-in-part of Ser. No. 28,242, Apr. 9, 1979, abandoned.

[51] Int. Cl.[3] ..... B32B 9/04; A21D 13/00

[52] U.S. Cl. ..... 428/447; 427/387; 427/391; 428/311.7; 428/452

[58] Field of Search ..... 428/447, 273, 264, 311.7, 428/452; 427/248 R, 387, 391

[56] References Cited

U.S. PATENT DOCUMENTS

| | | | |
|---|---|---|---|
| 2,306,222 | 12/1942 | Patnode | 428/273 |
| 2,386,259 | 10/1945 | Norton | 428/264 |
| 2,412,470 | 12/1946 | Norton | 427/248 R |
| 2,961,338 | 11/1960 | Robbart | 427/248 R |
| 2,995,470 | 8/1961 | Robbart | 427/248 R |
| 3,856,558 | 12/1974 | Robbart | 427/248 R |
| 4,170,690 | 10/1979 | Armbruster et al. | 428/447 |

*Primary Examiner*—Thomas J. Herbert, Jr.

*Attorney, Agent, or Firm*—Hill, Van Santen, Steadman, Chiara & Simpson

[57] ABSTRACT

A method for improving the water repellency of a naturally porous, moisture-containing paper web by treating the web with a coating composition containing as its active coating ingredient an alkyl alkoxysiloxane which reacts with the moisture contained in the paper web to produce a polymer and an alcohol as a by-product. The polymer substantially improves the water repellency of the paper web while the web retains substantially the porosity and the strength characteristics it had in the untreated state.

18 Claims, No Drawings

METHOD FOR WATERPROOFING PAPER

CROSS-REFERENCE TO RELATED APPLICATION

This application is a continuation-in-part of my copending Ser. No. 028,242 entitled "Method For Waterproofing Paper" and filed on Apr. 9, 1979, now abandoned.

BACKGROUND OF THE INVENTION

1. Field of the Invention

This invention is in the field of treating paper webs to render them less permeable by liquids while retaining their porosity and strength characteristics.

2. Description of the Prior Art

There have been some disclosures in prior patents regarding the treatment of various materials with organic silicon compounds in order to render them water repellent. For example, in U.S. Pat. No. 2,306,222 to Patnode, there is a disclosure of treating various materials, including paper, with an organo-silicon halide such as methyl silicon chloride in vapor form to render the body water repellent. It was hypothesized that the organo-silicon halide vapors react with an absorbed film of water to form the corresponding silicol which is strongly absorbed and water repellent, or results in the formation of a water repellent silicone.

U.S. Pat. No. 2,386,259 to Norton refers to the treatment of fabrics or paper to make them water repellent by treating such materials with the product obtained by the hydrolysis of a methyldihalogensilane.

Norton in U.S. Pat. No. 2,412,470 described a process for treating a solid body to render it water repellent which involved treating the same with a mixture containing about 2.8 to 99.2% by weight of trimethyl silicon chloride and about 97.2 to 0.8% by weight of silicon tetrachloride.

U.S. Pat. No. 2,961,338 to Robbart refers to a process of treating wool to render the same water repellent by reacting the same with an organo silicon halide in vapor form while the wool is at a relatively low moisture content.

Robbart in U.S. Pat. No. 2,995,470 described a continuous process for treating material with vapors of a waterproofing substance such as an organo silicon halide wherein vapors of the treating reagent mixed with an inert carrier gas were introduced into an enclosed treating zone while a length of the material to be treated was passed continuously through the zone. Downstream from the reaction zone the spent vapors, including the by-products, were exhausted from the system. The objective here was to remove the by-products as rapidly as possible so that they did not have an opportunity to build up appreciably in concentration.

In U.S. Pat. No. 3,856,558 Robbart suggested rendering cellulosic materials water repellent by contacting the same while they have a water content between 2 and 7 weight percent with vapors of a lower alkyl silicon halide which reacts with water to form a siloxane and maintaining the cellulosic material and halide in contact between 0.1 and 8 seconds. The conditions are such that the cellulosic material being contacted is rendered water repellent and has a pH greater than 2.5. The objective of this technique was to eliminate the subsequent step of neutralizing hydrogen chloride formed as a by-product of the alkyl silicon halide reaction with water.

Armbruster et al U.S. Pat. No. 4,170,690 suggested the use of a mixture of silanes to produce a coating composition which was said to impart abrasion resistance to thermoplastic substrates. The coating composition described therein contained about 30 to 50 parts by weight of a colloidal silica and about 50 to 70 parts by weight of a mixture of a dialkyldialkoxysilane and an alkyl trialkoxysilane with a weight ratio of about 1:19 to about 1:4 between the two. The coating compositions resulted in the production of gelled, impervious coatings which are not intended to be applied to a porous substrate such as paper.

While these disclosures appear in the prior art, the prior art has yet to come up with a method and composition for treating paper with silane solutions which are commercially acceptable. In those instances in which an alkyl silicon halide has been used, the disposition of the resulting hydrogen halide vapor has posed serious problems because of the corrosiveness of the vapor, the contamination of the atmosphere, and the weakening of the paper strength by its presence.

SUMMARY OF THE INVENTION

The treating process of the present invention involves treating a cellulosic web of paper, paperboard or the like with a spray containing an alkyl alkoxysiloxane, as such, or in pre-hydrolyzed form wherein it is essentially in the form of a hydroxysilane. The starting materials for the purposes of the present invention are identified by the following generic formula:

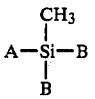

where A is H, $CH_3$, or B and B is an OR group in which R is methyl or ethyl.

The process of the present invention can supplement or replace conventional wet end sizing systems. It is applied to the dry web by means of a spray giving maximum efficiency of use of the treating chemical. The reaction by-products, consisting of a lower alcohol, are non-corrosive and of low toxicity. The effect of the treatment on paper is to produce a strong resistance to water while retaining the same porosity and strength characteristics of the untreated sheet. The treatment of the present invention can be applied to one or both sides of the sheet and the degree of water resistance can be controlled by controlling the severity of the treatment.

The alkyl alkoxysilane may be applied to the paper as such in the form of a spray, but is preferably introduced in the form of a solution in a suitable organic solvent such as a lower alcohol containing from 1 to 4 carbon atoms.

To cause the reaction between the alkoxysiloxane or its hydrolysis product to occur with the paper within resonable times, it is desirable to include a catalyst in the treating mixture. Such catalyst may be a strong mineral acid, an alkali metal peroxide, or an organometallic catalyst dissolved in a non-reactive organic solvent.

After the spray application of the material to the web, the sprayed material can be cured by means of subjecting the same to a slightly elevated temperature of about 300° F. (147° C.) or so for 15 to 60 seconds, or by leaving it at room temperature for at least 30 minutes.

DESCRIPTION OF THE PREFERRED EMBODIMENTS

In accordance with the present invention, a paper web has its water repellency improved by treatment with a liquid coating composition containing as its active coating ingredient, an alkyl alkoxysiloxane or its hydrolysis product, the alkyl alkoxysiloxane having the following formula:

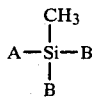

where A is H, $CH_3$, or B and B is an OR group in which R is methyl or ethyl.

Examples of the alkoxysiloxanes coming under this generic expression are given below:

A. Methyl trimethoxysilane:

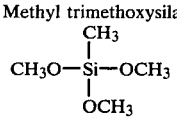

B. Methyl triethoxysilane:

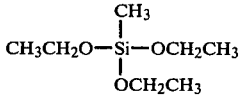

C. Dimethyl dimethoxysilane:

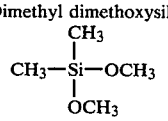

D. Dimethyl diethoxysilane:

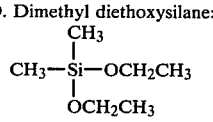

E. Methyl dimethoxysilane:

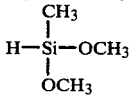

F. Methyl diethoxysilane:

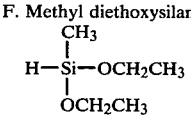

G. Methyl methoxyethoxysilane:

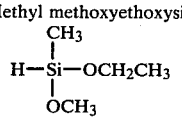

These alkoxysilanes react with water and cellulosic hydroxyl groups to produce a silicone polymer. The only by-product produced is a lower alcohol formed by hydrolysis of the alkoxy group. The alcohol by-product is relatively easy to dispose of, in contrast to hydrogen chloride, for example. Moreover, the surroundings can tolerate more of the alcohol than hydrogen chloride, as evidenced by the fact that the Environmental Protection Agency puts a limit of about 0.5 parts per million on hydrogen chloride in the atmosphere, but the limit on methyl alcohol is on the order of 1,000 parts per million.

The moisture content of the paper or other cellulosic base is not critical as long as it is within a resonably dry range of about 2 to 14% by weight. The reaction proceeds rapidly and to completion, particularly in the presence of a catalyst. The overall reaction is along the following lines:

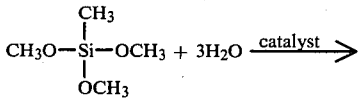

alkoxysilane

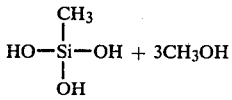

hydroxysilane

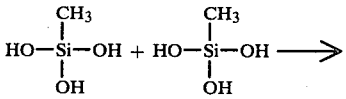

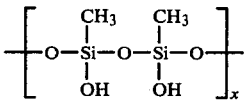

silicone polymer

The silicone polymer sticks to the cellulose fibers forming a hydrophobic surface which provides a water repellency.

While the silane can be used as such, it is preferable to combine it with a diluting solvent so that it provides a solution of about 1 to 3% by volume of the silane. This provides the optimum coverage with the least waste. An average water repellent coating on paper can be produced with a solution containing 1.5 to 2% by volume of the silane. The solvent used to dilute the silane can be nearly any volatile, anhydrous non-reactive organic liquid. The solvents which appear to work best for the solution are the lower alcohols containing 1 to 4 carbon atoms, such as ethanol or methanol. Since the by-products are themselves alcohols, the use of alcohol solvents poses no additional disposal problem.

The speed and the extent of the polymerization is dependent on the type of catalyst used. There are three different categories of catalysts which are useful to polymerize the silanes: strong acids, peroxide condensation catalysts, and organometallic condensation catalysts. Concentrated strong acids include materials such as sulfuric or nitric acid. Sulfuric acid appears to work best when added to the silane solution in the ratio of 1 ml of concentrated (95%) commercial acid to 250 ml silane solution. When the catalyst is added to the silane solution, a small amount of white precipitate may form due to water in the acid reacting with the silane. The paper is treated by spraying with the resulting solution and then curing. The curing can be accomplished by either heating at 300° F. (148° C.) for 15 to 60 seconds or allowing it to sit at room temperature for at least 30 minutes. Curing at room temperature is not very efficient because some silane loss will occur due to evaporation.

When treating the solution with a peroxide catalyst such as an alkali metal peroxide, the solvent can be the same as used in the case of a strong acid. In this technique, it is desirable that the silane be hydrolyzed before the peroxide catalyst is added. To accomplish this, a molar ratio of water equivalent to the number of alkoxy groups on the silane is added to the solution. An acid such as glacial acetic acid is added in a proportion of 1 ml acid to 400 ml solution to catalyze the hydrolysis. The solution should sit for at least one-half hour to make sure that the silane is completely hydrolyzed. The hydrolysis reaction proceeds as follows:

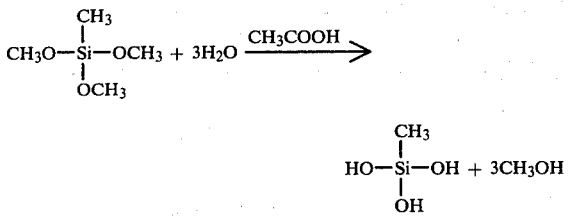

A peroxide can be added to the hydrolysis product in the ratio of about 1 gram peroxide to 500 ml solution. The best peroxide catalysts are sodium peroxide and potassium peroxide. This solution may be applied as a spray and the paper cured for 5 to 30 seconds at 300° F. (147° C.) for 5 to 15 minutes at room temperature. These solutions are somewhat basic and therefore raise the pH of the paper. This does not necessarily damage the sheet although it is desirable to hold the paper as close to its original pH as possible.

In treating with an organometallic catalyst, the solvent for the silane must be anhydrous and cannot be an alcohol. This is because the catalyst will react with water and alcohols preventing catalyzation of the polymer. The solvent should be a non-reactive organic solvent such as benzene, pentane, trichloroethane, or trichloroethylene. Trichloroethylene is the preferred solvent because it is non-flammable and has a low toxicity. A typical catalyst is tetra-iso-propyl titanate (TPT). This catalyst is added to the solution in the ratio of 1 ml TPT to 200 ml solution. The solution is most advantageously applied by spraying. The polymerization reaction is rapid and needs no curing or post-heating. Water repellency is imparted to the paper at the moment the spray contacts it. It has also been observed that during a period of several hours after the treatment there is a slight increase in the water repellency. This is due to short-chain silicone polymers joining to form longer chains, thus giving a slight increase in hydrophobicity. This solution does not affect the pH of the paper.

Organometallic tin compounds such as dibutyltin laurate, stannous oleate and tetrabutyl orthotitanate can also be used as catalysts. Tin compounds may be employed if the end use of the paper permits the presence of tin in the residual silicone.

The following specific examples illustrate the manner in which the invention is carried out, and the improved results achieved.

EXAMPLE I

A sample of 100 lb. bleached, unsized board was treated by spraying with a treating solution containing approximately 2% by volume methyl trimethoxysilane, with the balance methanol and a catalyst consisting of 1 ml of sulfuric acid per 250 ml of solution. The treated sample was then heated for 15 seconds in a 300° F. (147° C.) oven. The sample became quite water resistant.

EXAMPLE II

A sample of 100 lb. bleached, unsized board was treated as in Example I, using dimethyl diethoxysilane as the treating agent. Results substantially the same as those in Example I were obtained.

EXAMPLE III

Samples of 100 lb. bleached, unsized board were treated by spraying with a solution containing approximately 2% by volume methyl trimethoxysilane, water in an amount of 3 moles of water for every mole of silane, acetic acid in an amount of 1 ml acid for 400 ml solution, in a lower alcohol solvent, using a catalyst of sodium peroxide in an amount of 1 gram per 500 ml solution. The samples were heated for varying periods of time in a 300° F. (147° C.) oven. All of the sheets developed similar water resistant properties.

EXAMPLE IV

A sample of 325 lb. bleached blotter paper was treated with the same solution as in Example III and heated for 15 seconds in a 300° F. (147° C.) oven. The paper developed excellent water resistant properties, and was resistant to continuous running water.

EXAMPLE V

A sample of 325 lb. bleached blotter paper was treated by spraying with a solution containing approximately 2% by volume methyl trimethoxysilane, dissolved in benzene, and containing TPT in an amount of 1 ml per 200 ml of solution. No heating was done. The treated sheet was very water resistant, including resistance to running water.

EXAMPLE VI

The paper stock was treated as in Example V, but given only a very light spraying. The sheet was slightly water resistant to drops of water, but not to running water.

EXAMPLE VII

The paper was treated with the same composition as in Example V, but with a very heavy spraying. The sheet which resulted was very resistant to water under any conditions.

EXAMPLE VIII

This example utilized the same composition and procedure as in Examples V and VII, but the paper was treated on one side only. Both lightly treated and heavily treated papers were resistant on the treated side, with the greatest resistance in the heavily treated sheet. The untreated side of the heavily treated sheet showed a very slight water resistance.

EXAMPLE IX

A sample of 100 lb. N.S.S.C., unbleached board was treated by spraying with the composition described in Example V. No heating was done. The treated sheet was water resistant, although only slightly resistant to running water.

EXAMPLE X

The procedure here was the same as in Example IX, except the board was given only a light treatment. The resulting product was very slightly water resistant.

EXAMPLE XI

This procedure and composition was the same as used in Example IX, only a heavy treatment was applied. The resulting board was very water resistant, including resistance to running water.

EXAMPLE XII

The composition and method were the same as in Examples IX and XI, except that the board was treated on one side only. The normally treated side was slightly water resistant, and the untreated side had no water resistance. When heavily treated, the sheet was very water resistant on the treated side and slightly resistant on the untreated side.

EXAMPLE XIII

A sample of newsprint was treated with the solution set forth in Example V. An increased water resistance was developed in the sheet.

EXAMPLE XIV

The silane may be applied to a moving web without the use of a diluting solvent. In this case, a catalyst such as TPT should be present in amounts of from 10 to 15% by volume of solution for maximum polymerization efficiency. The application to the moving web must be in the form of a fine spray that atomizes but does not vaporize the silane. The treating chamber should be well ventilated to remove any vaporized silane and titania by-product from the reaction.

The application of the silane solution is most easily controlled by applying it as a spray or in the form of an aerosol. The spray can be adjusted to give the degree of coating desired as well as an even application. The solvent remaining in the paper can be removed by means of a vacuum or by heating.

Physical testing was done on some of these samples produced according to the examples set forth above. In the following table, "MD" refers to testing in the machine direction, and "CMD" refers to the cross machine direction. The Z-tensile strength tests were performed by applying a double-sided adhesive tape to the paper and stretching the same in an Instron machine. The brightness figures were derived from a General Electric brightness meter. The Unger oil test consisted in clamping a ring on the paper, pouring an oil under the ring, wiping off excess oil, and then weighing the sheet. The water absorption test was performed by applying about 0.1 ml of water to the paper, reflecting a light off it, and measuring the time elapsed until the reflection stops.

| Sample | % Moisture | pH | Ave. Burst Factor | Tensile MD | Tensile CMD | Average Z-tensile Strength | Ave. Bright-ness | Unger Oil Wire | Unger Oil Felt | Water Absorption (min) Wire | Water Absorption (min) Felt |
|---|---|---|---|---|---|---|---|---|---|---|---|
| Untreated | 7 | 8.960 | 14.52 | — | 30.7 | 35.20 | 84.8 | 167.0 | 148.1 | 0.23 | 0.23 |
| IV | 7 | 9.100 | 14.93 | — | 31.2 | 36.90 | 84.7 | 116.40 | 136.70 | ∞ | 53.00 |
| V | 7 | 7.450 | 15.69 | 69.6 | 30.8 | 35.00 | 83.3 | 106.80 | 123.40 | ∞ | ∞ |
| VI | 7 | 7.710 | 14.76 | 67.4 | 29.8 | 36.46 | 83.6 | 145.45 | 173.10 | 9.80 | 6.72 |
| VII | 7 | 7.900 | 13.10 | 62.2 | 29.3 | 32.56 | 83.6 | 105.85 | 79.25 | 23.07 → ∞ | 11.16 → ∞ |
| VIII normal | 7 | — | 15.34 | 67.7 | 33.0 | 33.54 | 83.2 | 150.00 | — | 0.08 | 12.40 |
| VIII heavy | 7 | — | 14.86 | 68.6 | 30.5 | 32.93 | 84.1 | 129.70 | — | 0.33 | 50.25 → ∞ |
| Untreated | 9.59 | 7.320 | 11.35 | 25.4 | 11.9 | 66.71 | 11.40 | 121.00 | 91.85 | 0.70 | 0.73 |
| IX | 9.59 | 7.270 | 12.26 | 25.3 | 12.5 | 67.68 | 11.50 | 94.50 | 82.80 | ∞ | 48.35 |
| X | 9.59 | 7.240 | 12.81 | 22.4 | 11.5 | 64.76 | 11.75 | 94.50 | 87.80 | 1.25 | 1.08 |
| XI | 9.59 | 7.270 | 12.04 | 24.4 | 11.7 | 67.93 | 11.23 | 94.00 | 84.25 | 20.75 | 5.86 |
| XII normal | 9.59 | — | 12.93 | 23.4 | 12.8 | 67.07 | 11.50 | 100.40 | 91.90 | 0.53 | 2.30 |
| XII heavy | 9.59 | — | 12.23 | 25.0 | 12.0 | 64.88 | 11.20 | 87.90 | 74.50 | 2.15 | 8.72 → ∞ |

COMPARATIVE EXAMPLES

Two solutions were made up exactly as stated in Examples I and IV of Armbruster U.S. Pat. No. 4,170,690. The solution of Example I of said patent was diluted to 20% solids after 24 hours, and the solution of Example IV was diluted to 20% solids after 24 hours. Both solutions were then aged for 48 hours, applied to various types of paper stock, and aged an additional 96 hours and again applied to various types of paper stock. It was found that the application of the material as a fine spray was difficult because of the high percentage of solids in solution. It was further found that the use of a priming solution as recited in said examples appeared to inhibit totally the waterproofing ability of the solution but unless such priming solutions were used, the solutions did not impart water resistance until they had been heated extensively. It was also found that the solutions soaked into the paper and did not react extensively with the surface, thus requiring greater amounts of solution to impart waterproofing. Even the greatest degree of water resistance obtained by the use of these examples was such that the surface of the paper could still be wet.

It should be evident that various modifications can be made to the described embodiments without departing from the scope of the present invention.

I claim as my invention:

1. The method of improving the water repellency of a naturally porous, paper web containing about 2 to 14% moisture by weight which comprises:

treating said web with a coating composition containing as its active coating ingredient an alkyl alkoxysiloxane having the formula:

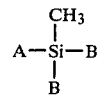

where A is H, $CH_3$, or B and B is an OR group in which R is methyl or ethyl, said coating composition being in liquid form and being substantially devoid of solids, said treating being carried out in the presence of a condensation catalyst, and reacting said alkyl alkoxysilane with the water contained in said web to thereby produce a water repellent paper web in which the reaction product impregnates within the pores of the paper to render the paper water repellent while said paper retains substantially the porosity and strength characteristics of the untreated web.

2. A method according to claim 1 in which said alkyl alkoxysilane is methyl trimethoxysilane.

3. A method according to claim 1 in which said alkyl alkoxysilane is methyl dimethoxysilane.

4. A method according to claim 1 in which said alkyl alkoxysilane is methyl triethoxysilane.

5. A method according to claim 1 in which said alkyl alkoxysilane is methyl diethoxysilane.

6. A method according to claim 1 in which said catalyst is a strong mineral acid.

7. A method according to claim 1 in which said alkyl alkoxysilane is applied to the web as a finely atomized spray in the absence of an added solvent.

8. A method according to claim 1 in which alkyl alkoxysilane is pre-hydrolyzed prior to application to said web.

9. A method according to claim 1 in which said alkyl alkoxysiloxane is dissolved in a volatile liquid solvent which is non-reactive toward said alkyl alkoxysiloxane.

10. A method according to claim 9 in which said solvent is an aliphatic alcohol containing from 1 to 4 carbon atoms per molecule.

11. A method according to claim 9 in which said alkyl alkoxysiloxane is dissolved in said solvent in an amount of from 1 to 3% by volume.

12. A method according to claim 1 in which said catalyst is a peroxide condensation catalyst.

13. A method according to claim 12 in which said peroxide is an alkali metal peroxide.

14. A paper web having improved water repellency on at least one surface thereof while retaining substantially all of its natural porosity toward gases, said surface comprising a silicone polymer produced by reaction of water in said web with a hydroxysilane which itself is the hydrolysis product of an alkyl alkoxysiloxane having the formula:

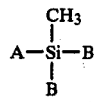

where A is H, $CH_3$ or B and B is an OR group in which R is methyl or ethyl.

15. A paper web according to claim 14 in which said alkyl alkoxysiloxane is methyl trimethoxysilane.

16. A paper web according to claim 14 in which said alkyl alkoxysiloxane is methyl dimethoxysilane.

17. A paper web according to claim 14 in which said alkyl alkoxysiloxane is methyl triethoxysilane.

18. A paper web according to claim 14 in which said alkyl alkoxysiloxane is methyl diethoxysilane.

* * * * *